US005117244A

United States Patent [19]

Yu

[11] Patent Number: 5,117,244

[45] Date of Patent: May 26, 1992

[54] NOZZLE CAPPING DEVICE FOR AN INK JET PRINTHEAD

[75] Inventor: Zhao-Zhi Yu, Webster, N.Y.

[73] Assignee: Xerox Corporation, Stamford, Conn.

[21] Appl. No.: 764,299

[22] Filed: Sep. 23, 1991

[51] Int. Cl.[5] ..... B41J 2/02; B41J 2/04

[52] U.S. Cl. ..... 346/140 R; 346/75

[58] Field of Search ..... 346/140 R, 75; 400/126; 29/890.1

[56] References Cited

U.S. PATENT DOCUMENTS

| | | | |
|---|---|---|---|
| 4,533,927 | 8/1985 | Iwagami et al. | 346/140 R |
| 4,539,574 | 9/1985 | Broome et al. | 346/139 R |
| 4,543,589 | 9/1985 | Terosawa | 346/140 R |
| 4,970,534 | 11/1990 | Terasawa et al. | 346/140 R |

*Primary Examiner*—Benjamin R. Fuller
*Assistant Examiner*—Victor DeVito
*Attorney, Agent, or Firm*—Robert A. Chittum

[57] ABSTRACT

A device to cap a thermal ink jet printhead, without the need of moving the printhead or the paper transport is described. The capping device has a resilient gasket which contains magnetic material and is attached to the printhead by a relatively thin flexible boot or sleeve. A steel bar is disposed in sliding contact beneath a paper transport belt. The belt is adjacently spaced parallel to the printhead. The paper transport belt is flat and smooth and has a hole-free surface. During operation of the printer, an electromagnet disposed on the printhead is energized and attracts the magnetic gasket, resulting in the attraction of the gasket above the printhead nozzles to enable printing. When the printhead is not in operation, the electromagnet is de-energized, allowing the steel bar to attract the magnetic gasket and seal the gasket to the belt, capping the printhead. The capping device eliminates the need for movement of the printhead or moving the paper transport. Also, the capping device provides capping protection in case of a power failure.

11 Claims, 4 Drawing Sheets

NOZZLE CAPPING DEVICE FOR AN INK JET PRINTHEAD

BACKGROUND OF THE INVENTION

This invention relates generally to a nozzle capping device for use in an ink jet printer, and more particularly concerns a device to cap nozzles in an ink jet printhead, when the ink jet printer is not in operation, without the need of moving the printhead or the paper transport.

An ink jet printer may be either the "continuous stream" or the "drop-on-demand" type. In the continuous stream type of printer, ink is emitted under pressure continuously from one or more orifices in a printhead. The ink in the printhead is perturbated by, for example, a piezoelectric device causing the streams of ink to breakup into droplets a predetermined distance from the nozzles where charging electrodes are located. The charging electrodes induce charges on the droplets which are then deflected by fields produced by deflection electrodes as necessary, so that they are deposited either in a specific location on a recording member or, if not required for printing, in a gutter from where they are collected and recirculated. In the drop-on-demand type of printer, ink is contained in a plurality of channels in a printhead under a slightly negative pressure and electrical energy pulses are used to rapidly heat thermal transducers in the channels to form momentary ink vapor bubbles which cause the droplets of ink to be expelled, as required, from orifices at the ends of the channels and to be directed towards a recording member.

When the ink jet printer is not in operation, ink not expelled in one or more orifices can dry and clog the orifice, causing failure or reduced ink flow through the orifice resulting in poor print quality. It is well known that capping of the printhead can prevent ink from drying in the orifices. Thus, ink jet printers have employed a capping station to cap the ink jet nozzles. These capping stations involve moving the printhead to the capping station or moving the paper transport to enable access of a capping device.

In an ink jet printer that has a full width printhead, it has been found that it is undesirable to move the printhead. The alignment of the printhead is difficult to maintain with a printing plane, thus moving the printhead has adverse effect on print quality. Capping of a fixed full width printhead may also be achieved by moving the paper transport out of interference with the path of movement by a capping station, and then placing the capping station into engagement with the printhead, this method may involve a costly and complicated moving mechanism that can fail or wear out. Also, the method of moving the printhead and/or the capping station into engagement with each other or the method of moving the paper transport out of interference with the capping operation may not provide capping protection in the event of a power failure.

Various other approaches have been devised to cap ink jet printhead when the ink jet printer is not in operation, the following disclosure appears to be relevant:

U.S. Pat. No. 4,533,927 to Iwagami et al. discloses a capping mechanism for preventing nozzle blocking in an ink jet system printer. A capping mechanism includes a cap member supported by a slidable plate. The slidable plate is shifted toward the printer head as the printer head moves to the stand-by position through use of links whereby the cap member covers the nozzle portion including the printhead. That is, the slidable plate is shifted by the travel force of the carriage and, therefore, a separate drive source is not required for the slidable plate.

U.S. Pat. No. 4,539,574 to Broome et al. discloses a pen capping mechanism. The system utilizes a flat bar of plastic as a slider member with as upper surface adapted to sealably mate with the tips of the pens. The slider member is supported for longitudinal movement on a support track and is moved between positions by an operator connected thereto.

U.S. Pat. No. 4,543,589 to Terasawa discloses a capping device for ink jet nozzles. The device provides a cap for an ink jet nozzle which prevents an ink pool from forming around the front ends of the nozzle. The capping device includes an ink absorbing element and an elastic member surrounding the ink absorbing element and arranged in a position as to be brought in contact with the ink jet head to tightly seal the front end of the head.

U.S. Pat. No. 4,970,534 to Terasawa et al. discloses an ink jet recovery device having a spring-loaded cap and a mechanism for pressing the cap against a recording head to seal the printhead nozzles. The device comprises an elastic cap that is movable between a retracted position, in which it is spaced from a recording head, and an in-contact position, in which it is pressed against the recording head. The recovery device also includes a rotatable drive gear having a cam surface, with a retracting cam and a compression cam, for moving the cap.

Even with the above-mentioned teaching available, the problem remains with capping the printhead without the need of moving the printhead or the paper transport and capping when a power failure occurs.

SUMMARY OF THE INVENTION

In the present invention, a device to cap a thermal ink jet printhead, without the need of moving the printhead or the paper transport is described. The capping device has a resilient gasket which is attached to the printhead by a relatively thin, flexible boot or sleeve. The gasket contains magnetic material and may be simply a lower rolled cuff portion of the sleeve. A steel plate or bar is disposed beneath and parallel to a span of a paper transport belt, which belt span is adjacently spaced parallel to the printhead. The paper transport includes a flat, smooth, movable belt having a hole-free surface mounted on rollers, at least one of which is driven. During operation of the printer, an electromagnet disposed on the printhead is energized to attract the gasket, resulting in the retraction of the gasket. With the gasket retracted the the printhead is permitted to operate. When the printhead is not in operation, the electromagnet is de-energized, allowing the steel bar to attract the gasket and seal the gasket to the belt, resulting in the printhead being capped. The capping device eliminates the need for movement of the printhead or moving the paper transport. Also, the capping device provides capping protection in case of a power failure, since such failure releases the magnetic gasket and the gasket is attracted to the steel plate, thereby sealing itself tightly against the intermediate or sandwiched belt span.

In accordance with one aspect of the present invention, there is provided a device for capping a printhead on an ink jet printer including an elastomeric seal or gasket containing ferromagnetic material. The gasket is attached around the printhead by a thin flexible sleeve. Means for generating a first magnetic field in the region of the printhead for sealing the gasket to a transport belt, so that the printhead is capped. Another means for selectively generating a second magnetic field in the region of the printhead which is stronger than the first magnetic field and in the opposite direction to keep the gasket from the belt so that the printhead is uncapped.

Pursuant to another aspect of the present invention, there is a provided a maintenance station for priming and cleaning ink jet nozzles, including a transport belt having a slit and a steel bar having a groove with a hole defining a drain port. The steel bar groove is aligned with the printhead. The transport belt is moved into alignment with the steel bar groove, so that when the printhead is capped against the transport belt, the capping means sandwiches the belt between the steel bar and printhead and forms a tight seal between the printhead and the steel bar groove, thereby enabling a vacuum at the groove drain port to prime the printhead.

BRIEF DESCRIPTION OF THE DRAWINGS

Other aspects of the present invention will become apparent as the present invention is described by way of example with reference to the drawings, wherein like parts have like reference numbers, and wherein.

Inasmuch as the art of ink jet printing is well known, the various processing stations employed in the FIG. 1 printing machine are shown schematically and their operation described hereinafter briefly with reference thereto.

DETAILED DESCRIPTION OF THE INVENTION

Figure 1:
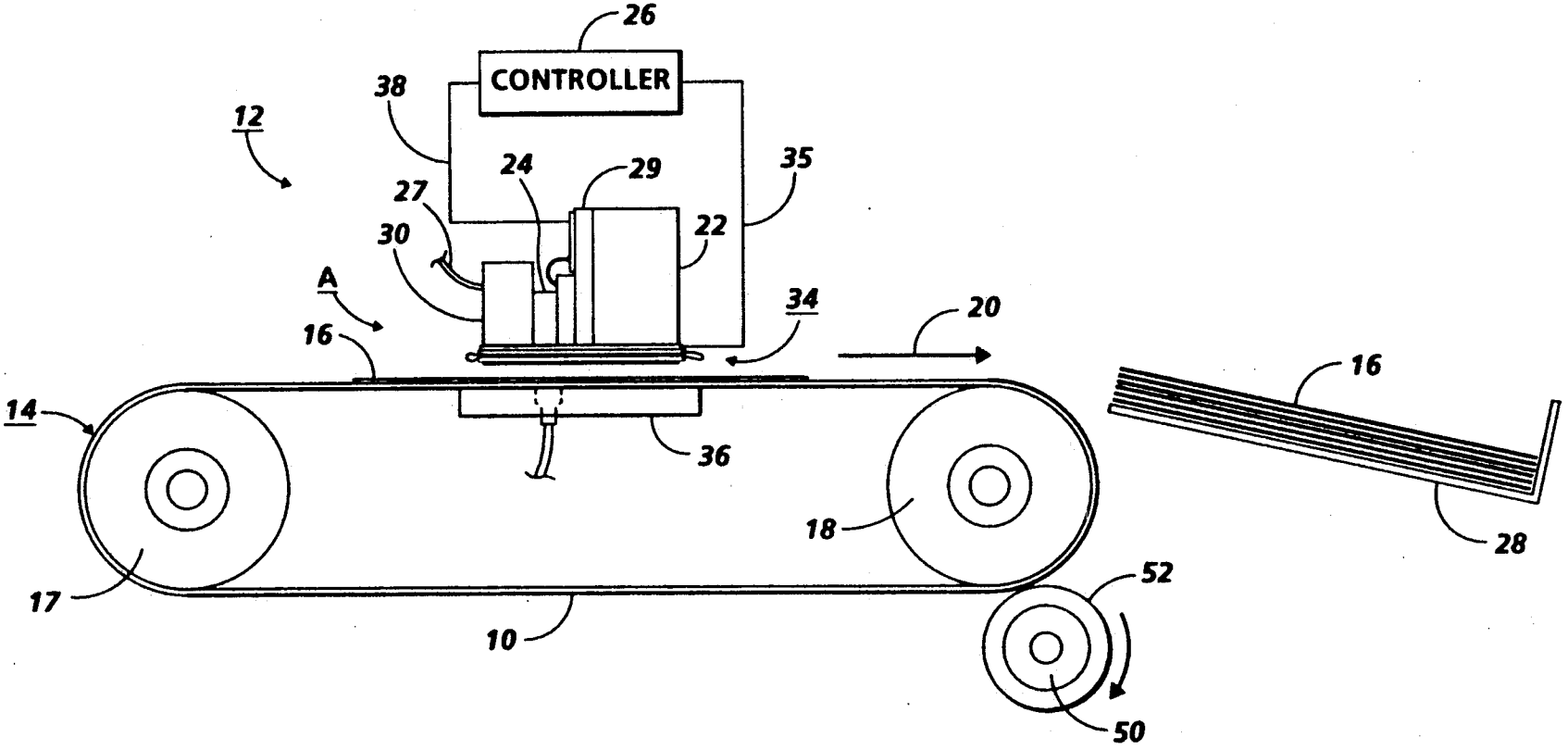
FIG. 1 is a side schematic view of a ink jet printer incorporating the capping device of the present invention.
Figure 2:
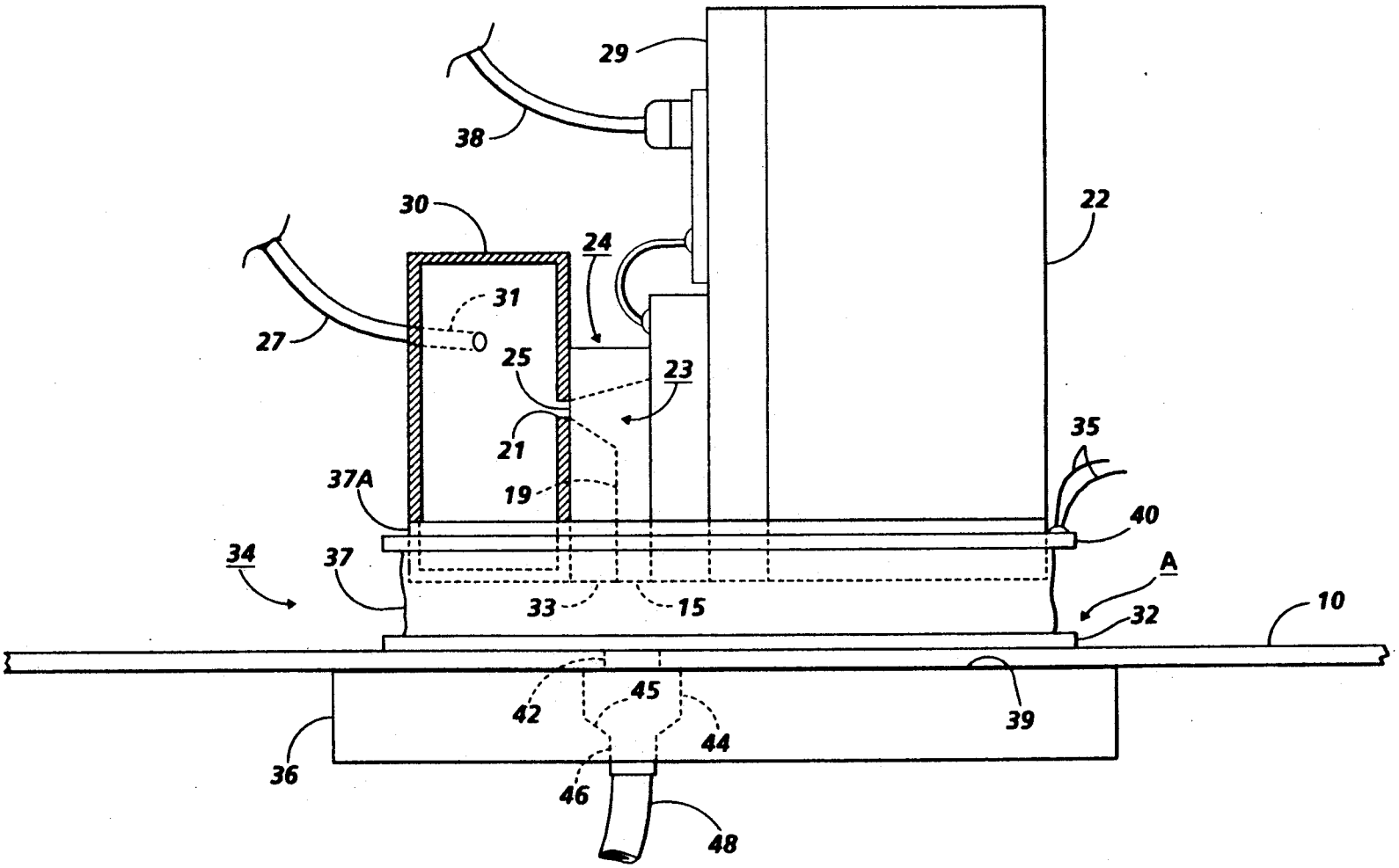
FIG. 2 is an enlarged schematic side view of the capping device of FIG. 1, showing the printhead capped.

Turning now to the figures, FIG. 1 is a side schematic view of a thermal ink jet printer 12. The ink jet printer 12 employs a transport belt mechanism 14 with belt 10 mounted around rollers 17 and 18, one of which is driven by a motor (not shown). The belt 10 moves paper sheets 16 seriatim in the direction of arrow 20 when they are placed thereon from a typical cassette or paper supply by a sheet feeder, neither shown. Moreover the paper sheet 16 moves through a printing station generally referred to by reference letter A. While moving through the printing station A, the paper sheet 16 may be printed by a full width printhead 24 having one or more ink inlets 25 and a plurality of ink droplet emitting nozzles 15 (see FIG. 2). The printhead 24 is fixedly located on a printed circuit board 29, which in turn is mounted on a mounting substrate 22, preferably of graphite, but any metal such as steel or aluminum could be used. The mounting substrate not only provides the structural integrity for mounting of the printhead in the printer 12, but also a means for heat management, since it readily conducts and dissipates heat. Referring also to FIG. 2, an ink manifold 30, containing ink, is mounted on the side of the printhead 24, opposite the one adjacent the mounting substrate, and is in sealed communication with the printhead inlets 25 through openings 21 in the manifold to supply ink to the printhead. The main ink supply (not shown) is located separately from the ink manifold in the printer and is connected to the ink manifold by hose 27 sealingly attached to ink manifold inlet 31. The printhead 24 has a plurality of parallel ink channels 19 connecting the ink inlets 25 via a common reservoir 23 to respective and an ink ejecting orifices or nozzles 15 which penetrate the front surface 33 of printhead 24. The capping device 34 of the present invention will be described hereinafter with reference to FIG. 2.

To print the required information, a controller 26, including a microprocessor (not shown) controls energy pulses that are usually produced by resistors (not shown), each located in a respective one of the channels, by individually addressing each resistor with current pulses via lines 38 and electrical circuitry (not shown) on both the printed circuit board and the printhead to heat and vaporize ink in the channels. As a vapor bubble grows in any one of the channels, ink bulges from the channel orifice 15 until the current pulse has ceased and the bubble begins to collapse. At that stage, the ink within the channel retracts towards the collapsing bubble and separates from the bulging ink, which forms a droplet moving in a direction away from the orifice and towards the paper sheet. The channel is then re-filled by capillary action, which in turn draws ink from the ink manifold 30 and the process repeats until the desired information is printed. After printing, the paper sheet 16 leaves printing station A and it is transported by belt 10 to exit tray 28, where the printed sheets are stacked.

When printing is no longer desired and the printer is turned off or a power failure occurs, a gasket 32 of the capping device 34 mounted on printhead 24 is attracted by steel bar 36, located beneath belt 10 in alignment with printhead 24, and is urged against the smooth surface of belt 10 or paper sheet thereon, thus capping the printhead as described below.

Figure 3:
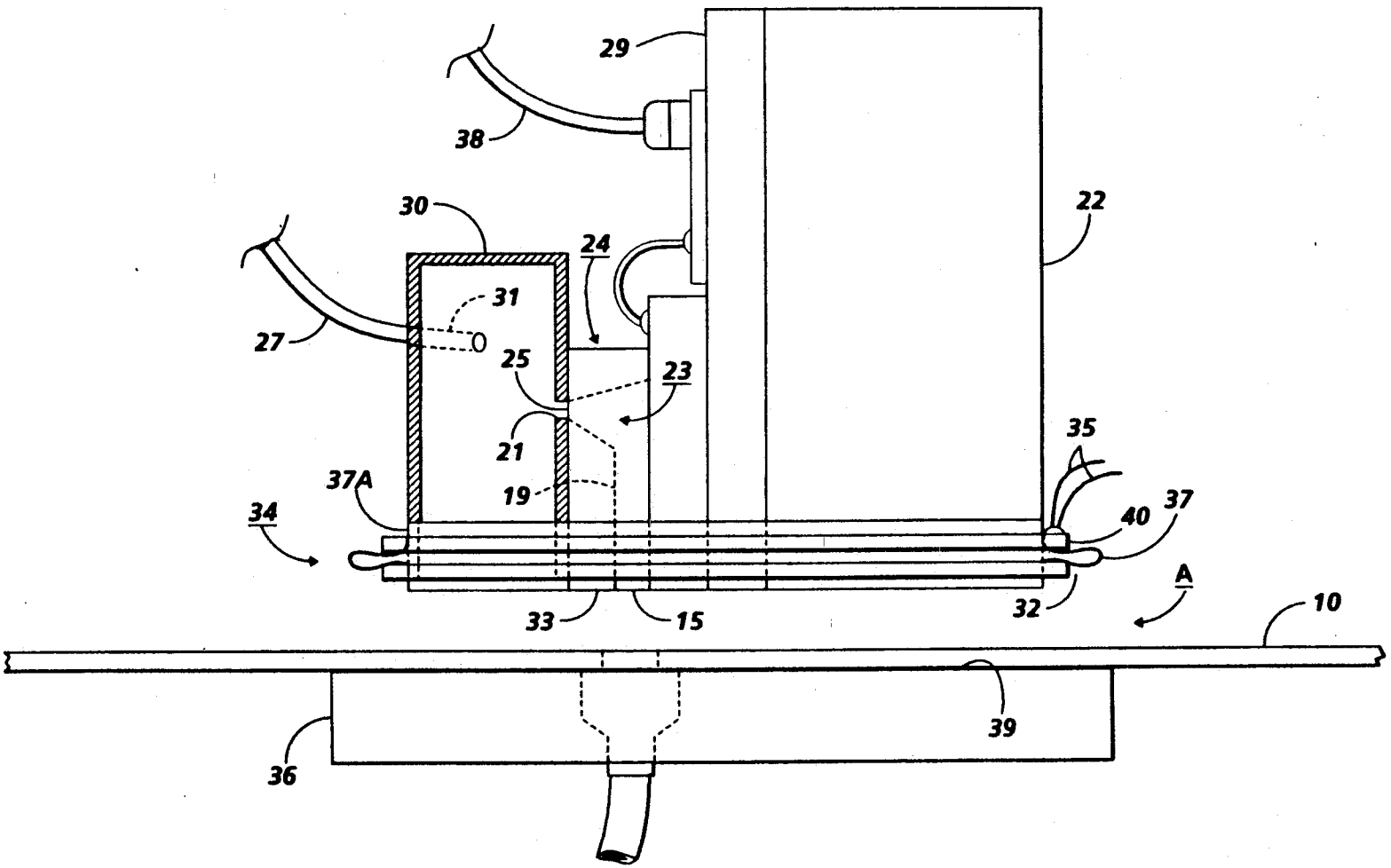
FIG. 3 is a view similar to FIG. 2, showing the capping device retracted so that the printhead is uncapped.
Figure 4:
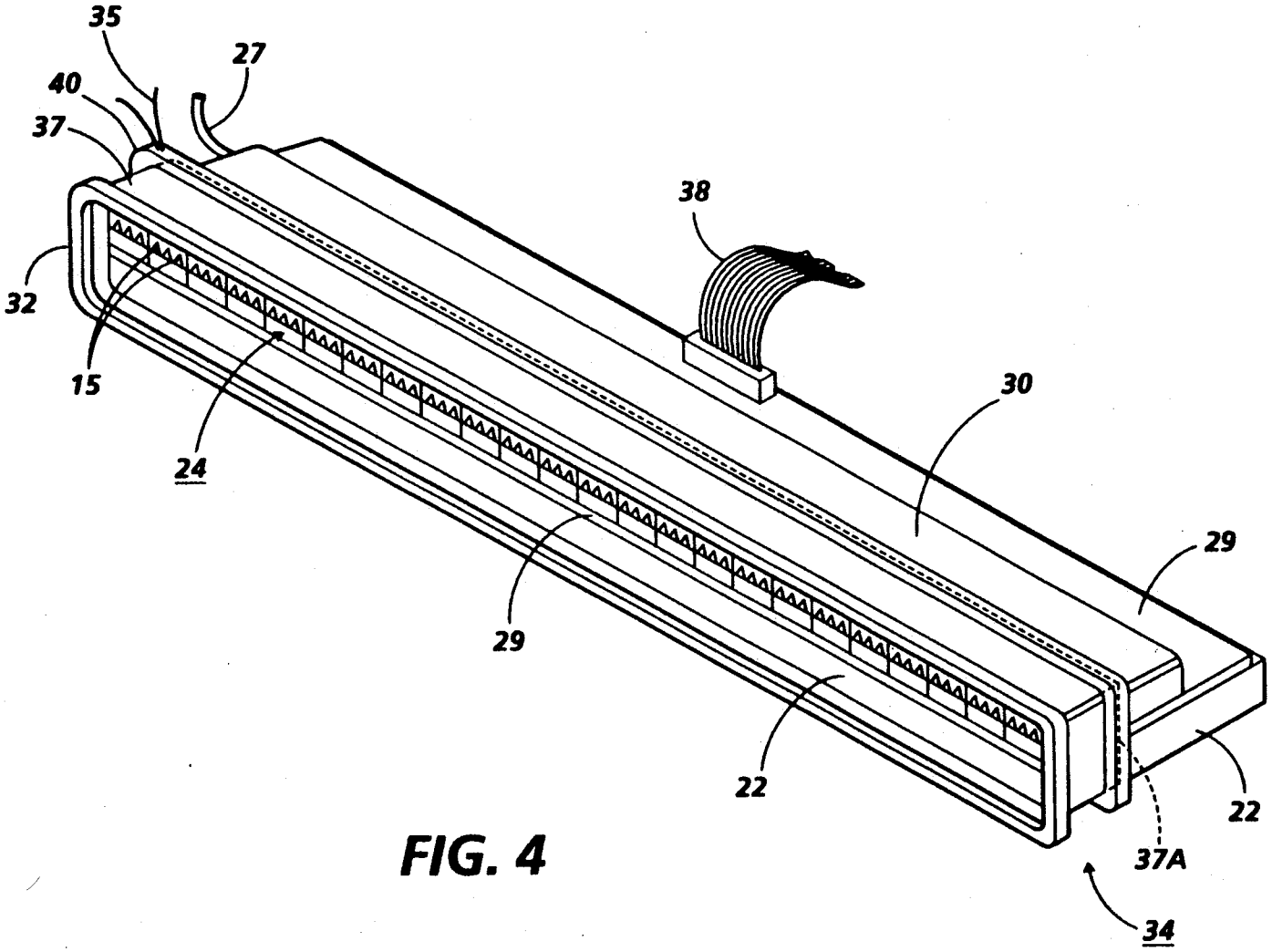
FIG. 4 is an isometric schematic view of the capping device in FIG. 2 looking into the printhead nozzles with the printer transport belt removed.

Referring now to FIGS. 2 through 4, the detailed structure of the capping device 34 comprises a fixedly mounted electromagnet 40 located around the printhead and printhead supporting components of ink manifold 30 and mounting substrate 22, a resilient gasket 32 having a composition of rubber or other suitable elastomeric material and containing a magnetic material, for example magnetite, and a relatively thin flexible or resilient sleeve 37 having opposing ends, one end 37A of which is bonded around an end portion of the ink manifold, printhead, circuit board and mounting structure which confront the transport belt 10 at the printing station A. The other end of the sleeve is attached to the gasket. The gasket could be a rolled up end portion of the sleeve containing a magnetic material rolled up therein to form a roll cuff at bottom end of the sleeve 32 instead of a separate gasket attached to the sleeve. The bonded end 37A of sleeve 37 provides an air tight seal around the printhead and the other components. Belt 10 is spaced beneath the printhead and the gap therebetween is about 20–40 mils. The steel bar 36 is position directly under the belt 10 and parallel thereto, with steel bar surface 39 in sliding contact with the belt. The controller 26 normally energizes the electromagnet 40 via lines 35 during the printhead operation mode, in which the printhead is printing on sheets 16. When the electromagnet 40 is energized, it attracts the gasket 32 and holds the gasket in a position spaced from the front face 33 of the printhead and from the belt 10, as shown in FIG. 3. When the ink jet printer is not in operation or a power failure occurs, the attraction force between the magnetic gasket 32 and steel bar 36 provides an air tight cap between the belt 10 and the printhead 24, as shown in FIG. 2.

FIG. 4 is an isometric view of the pagewidth printhead 24 mounted on the printed circuit board 29, mounting substrate 22, manifold 30, and capping device 34 with the electromagnet 40 de-energized, as viewed from the transport belt 10. Thus, FIG. 4 is just another view of the capping device as shown in FIG. 2, but with the transport belt and steel bar removed for clarity. Note the mounting substrate 22 is cut to form notch 22A to accommodate the capping device 34.

Although the orientation of the pagewidth printhead is shown to print downward with gravity, other orientations are equally applicable. In the orientation shown, the capping device also operates vertically, so that gravity aids in moving the gasket 32 into intimate contact with the belt. However, by adjusting the relative forces of the magnetic material in the gasket and the electromagnet 40, the capping device would work equally well in other orientations without the need of the assistance of gravity. In all orientations, of course, the attractive force of the electromagnet must be greater than that between the magnetic gasket and the steel bar.

In an alternate embodiment, the capping station may also provide the function of a maintenance station by placing a slit 42 (shown in dashed line), having the length of printhead 24 and at least the width of nozzles 15, in the belt 10 and by forming a groove 44, having a size corresponding to or greater than that of the belt slit 42, in the steel bar or plate 36. The groove in the steel bar has a sloping floor 45 and a drain port 46. A vacuum is selectively applied to the drain port by hose 48. Thus, when the ink jet printer is turned off or during printer start-up, the printhead can be capped onto a maintenance station, so that the ink jet nozzles can be primed and/or cleaned. For the maintenance station function to be available, the slit in the belt is positioned over the corresponding sized groove in the steel bar 36 by the controller. The printhead can periodically eject droplets into the groove or a suction can be supplied to suck ink from the printhead nozzles thereby priming the printhead.

During the printing operation of the ink jet printer, a electromagnet 40 located around the printhead, ink manifold, and mounting substrate is energized and produces a magnetic field that attracts the magnetic material in the gasket 32. The magnetic force produced by electromagnet 40 is stronger than the magnetic force between the steel bar 36 and the gasket 32, so that the gasket 32 unseals from the belt 10 and lifts the gasket 32 to a height above the front face of the printhead which allows paper path to be clear and printing operation of the printer to begin.

During a power failure, the capping device automatically caps the printhead, because as soon as the electromagnet is de-energized, the magnetic material in the gasket is attracted to the steel bar underneath the belt, thereby sealing the gasket against belt 10 or a paper sheet thereon and concurrently squeezing the paper sheet, if there, and the belt against the steel bar. Once the power is restored, the controller may energize the electromagnet and attract the gasket from the belt. At this time, the controller may move the belt to remove any paper sheet thereon and then to move the belt until the slit therein is aligned with the steel bar groove and then de-energize the electromagnet, so that the printhead is again sealed. This time, however, the printhead may eject nozzle clearing droplets or be primed again by a vacuum selectively activated by the controller. Capping the printhead against the belt does not normally cause ink to be placed or deposited on it. However, an ink cleaning and absorbing means, such as a roller 50 with a layer 52 of absorbent material could be optionally added to the printer 12 to clean the belt 10, as shown in FIG. 1.

While the capping device is shown incorporated on a full width ink jet array, it should be understood that the capping device could be employed in other applications if desired. For example, the capping device could be attach to a partial width array (not shown) that moves on a scanning carriage (not shown).

It is, therefore, evident that there has been provided, in accordance with the present invention a magnetic capping device that fully satisfies the aims and advantages hereinbefore set forth. While this capping device has been described in conjunction with various embodiments thereof, it is evident that many alternatives, modifications and variations will be apparent to those skilled in the art. Accordingly, this invention is intended to embrace all such alternatives, modifications and variations as fall within the spirit and broad scope of the appended claims.

I claim:

1. A capping device for a printhead means in an ink jet printer, the printhead means having a linear array of nozzles forming an array length in a nozzle face, and the printer having a transport belt for moving a plurality of recording mediums seriatim past the printhead means, one span of the transport belt confronting but being spaced from the printhead nozzle face, comprising:

a relatively thin, flexible sleeve having a predetermined internal dimension and opposing ends, one end of the sleeve being bonded to the printhead means, so that the sleeve sealingly surrounds the printhead means portion having the nozzle face;

an elastomeric closed loop gasket containing a magnetic material, the gasket being attached to the end of the sleeve opposite the one bonded to the printhead means;

a fixed bar being constructed of a material which is magnetically attractable to magnetic material, the bar being positioned on a side of a span of the transport belt opposite a side confronting the printhead means nozzle array and in sliding contact therewith, the bar being aligned and parallel with the printhead nozzle face, so that the fixed bar generates a first magnetic field in a region of the printhead which attracts said gasket toward the span of the transport and transport belt intermediate the gasket and bar;

means for selectively producing a second magnetic field in the region of the printhead which is stronger than the first magnetic field and adapted to attract said gasket in a direction opposite the first magnetic field, the means for producing the second magnetic field being located in a vicinity of the sleeve end bonded to the printhead, so that, when the second magnetic field is produced, said second magnetic field overcomes the first magnetic field and holds the gasket in a position spaced from the transport belt and when the second magnetic force is not produced, the transport belt is stopped and the first magnetic field causes the gasket to be tightly sealed against the transport belt, thereby capping the printhead nozzles in said nozzle face.

2. The device of claim 1, wherein the fixed bar material is steel, and wherein the means for selectively producing a second magnetic field is an electromagnet.

3. The device of claim 2, wherein the fixed bar contains an elongated groove having a length and width therein in alignment with the printhead, the groove length at least equal to the length of the nozzle array and the groove width at least equal to a width of a nozzle and having a floor with a drain port therein; wherein the transport belt has a slit therein having a dimension substantially equal to the length of the nozzle array and width at least equal to the width of a nozzle; and wherein the device further comprises:

means for stopping the transport belt slit in alignment with the fixed bar groove; and means for selectively applying vacuum to the groove drain port, so that when the nozzles are capped, the nozzles may be cleared by ejecting droplets into the fixed bar groove and the printhead may be primed by action of the vacuum sucking ink from the nozzles.

4. The capping device of claim 2, wherein the printhead means comprises a pagewidth printhead, printed circuit board, mounting substrate, and ink manifold.

5. The capping device of claim 4, wherein the printhead has first and second parallel opposing sides which are perpendicular to an edge thereof representing the nozzle face which contains said nozzle array, the printhead second side having ink inlets therein; wherein the printhead first side is mounted on a top surface of the printed circuit board and electrically connected thereto; wherein the printed circuit board has a bottom surface bonded to the mounting substrate for providing structural integrity to the printhead means; and wherein the ink manifold has ink outlets; and is mounted on the printhead second side with the manifold ink outlets being aligned and sealed with the printhead inlets, so that the manifold provides a supply ink to said printhead.

6. The capping device of claim 5, wherein the mounting structure is graphite.

7. The capping device of claim 6, wherein the sleeve end bonded to the printhead means surroundingly seals around the manifold, printhead, printed circuit board, and mounting structure.

8. The capping device of claim 7, wherein the electromagnet is annularly shaped and is surroundingly mounted around the printhead means adjacent the sleeve end bonded to the printhead means, and wherein the electromagnet is energized when the printhead is to print information on the recording mediums moved therepast on the transport belt, so that the gasket is held thereby, but is attracted to the steel bar when the electromagnet is de-energized thereby providing an automatic fail safe capping of the printhead nozzles in case of a power failure.

9. The capping device of claim 8, wherein the printhead means is oriented to expel droplet vertically; and wherein gravity assists an attraction of the capping device gasket to the steel bar.

10. The capping device of claim 9, wherein the gasket seals against a paper sheet if the electromagnet is de-energized while a paper sheet resides on the transport belt in a location between the gasket and the steel bar.

11. The capping device of claim 8, wherein the capping device further comprises a cleaning roll to clean the transport belt and removes any ink that is inadvertently placed thereon while the printhead means is capped.

* * * * *